United States Patent [19]

Weihrauch

[11] 4,237,573

[45] Dec. 9, 1980

[54] DEVICE FOR RELEASABLY SECURING A CLEANING IMPLEMENT TO A HANDLE

[75] Inventor: Georg Weihrauch, Wald-Michelbach, Fed. Rep. of Germany

[73] Assignee: Coronet-Werke Heinrich Schlerf GmbH, Fed. Rep. of Germany

[21] Appl. No.: 56,240

[22] Filed: Jul. 10, 1979

Related U.S. Application Data

[63] Continuation-in-part of Ser. No. 769,969, Feb. 18, 1977, Pat. No. 4,169,297.

[30] Foreign Application Priority Data

Feb. 18, 1976 [DE] Fed. Rep. of Germany ..... 2606400
Mar. 19, 1976 [DE] Fed. Rep. of Germany ..... 2611683
Nov. 11, 1976 [DE] Fed. Rep. of Germany ..... 2651259

[51] Int. Cl.[3] ..... A47L 13/11; B25G 3/28

[52] U.S. Cl. ..... 15/145; 15/245; 403/374

[58] Field of Search ..... 15/145, 146, 147 B, 15/152, 148, 154, 176, 147 C, 229 B, 229 BC, 229 BP, 229 BW, 144 R; 403/374, 409

[56] References Cited

U.S. PATENT DOCUMENTS

| | | | |
|---|---|---|---|
| 1,194,048 | 8/1916 | McKay | 15/152 |
| 1,903,018 | 3/1933 | Wohlhieter | 15/147 C |
| 2,866,214 | 12/1958 | Phillips | 15/145 X |

*Primary Examiner*—Edward L. Roberts
*Attorney, Agent, or Firm*—Craig & Antonelli

[57] ABSTRACT

A handle having a sprung forked end with two branch arms in the form of a fork is releasably securable to a cleaning-implement body by engagement of the branch arms in apertures in the body by means of a clamping device which is movable with respect to said branch arms and includes a pivoting lever.

17 Claims, 12 Drawing Figures

DEVICE FOR RELEASABLY SECURING A CLEANING IMPLEMENT TO A HANDLE

This application is a continuation-in-part of application Ser. No. 769,969 filed Feb. 18, 1977, now Pat. No. 4,169, 297 .

BACKGROUND AND SUMMARY OF THE INVENTION

The present invention relates to a device for securing cleaning-implements, such as brooms, scrubbers, squeegees or the like to a handle, at the end of which there are two sprung branch arms forming a fork, which are securable in apertures of the body of the cleaning-implement.

In known practical forms of the construction for brooms or scrubbing-implements, the branch arms extending parallel to each other are bent above the brush body, extended outwardly horizontally above the brush body, then again bent and introduced into the holes in the brush body. For clamping purposes two spring members are used, which are mounted to the horizontal portions of the branch arms of the respective springs having one limb inserted in an additional hole in the brush body and the other limb engaging behind the parallel portion of the respective branch arm.

By means of these spring members, whose limbs which engage behind the branch arms are, if necessary, interconnected in yoke fashion, the ends which engage the holes of the brush body are forced against the walls of the hole and thereby secured in position.

These known handle fixing devices are expensive and their external appearance is not particularly satisfactory. Moreover, the securing of the handle involves several difficulties because the user must exert considerable force for the mounting and the disassembling of the handle.

In another known practical form, U.S. Pat. No. 1,692,110 the mounting operation is substantially simplified. In this case upon one of the branch arms there is hinged a sheet metal bridge, which at its other end carries a hook corresponding in shape to the cross section of the other branch arm. This bridge member is so pivoted that the hook partially engages over the other branch arm so that the bridge member then extends between both of the branch arms. By pressing into position the hook of the bridge member, the branch arms, the ends of which are outwardly bent, are brought into the spread apart condition and thus secured in the holes in the cleaning-implement.

Although this practical form of device is indeed easy to manipulate, it nevertheless has the disadvantage that it is quite easily released. The effect of a slight impact or the influence of torsional forces upon the two branch arms causes the bridge member to spring out. This type of securement is therefore quite unsuitable for the present practical purpose.

In still another known arrangement, U.S. Pat. No. 1,929,848, a pivoting lever is disposed parallel to and above the fork arms, said lever being swivelable on the end of the handle about an axis perpendicular to the latter. The stop is made in the form of a thin-walled strip of sheet metal. In one position of the pivoting lever, in which it is aligned flush with the handle, the fork arms are spread apart, so that the bent ends of said arms firmly grip the body of the cleaning implement. With the pivoting lever in the other position, the fork arms can spring back into their original position, in which they are located closer together and can be removed from the openings in the body of the cleaning implement. Thus, the body can be removed from the handle. The disadvantage of this arrangement is that accidental striking of the pivoting lever causes the latter to leave the clamping position and releases the cleaning implement body at a time when this is undesirable. Naturally, this danger exists in the case of cleaning implements used in the home, especially since it is impossible to avoid striking furniture such as chairs, heaters, and the like with the lower part of the handle.

The present invention therefore takes as its basic purpose the construction of a device of the above-mentioned type in such a manner that it is easy to manipulate but, on the other hand, will offer a sufficient resistance to any pressure, tension and torsional forces arising from the use of the cleaning implement.

Starting from the basis of a device of the construction first above-mentioned, this problem is solved in accordance with the invention in that the device for securing the branch arms to the body of the cleaning implement is a clamping device carried, at least in the clamping position, upon both of said branch arms and having a manual control member and which, by pivoting, can be brought out of an open position into a closed or clamping position.

The adoption of the present invention renders superfluous the use of the spring members of the type necessary in the known art, and thus eliminates the difficulties encountered in the fitting thereof. On the contrary, only one hand is necessary for manipulating the manual control member, and the amount of force necessary for that purpose can be maintained small by suitable design of the clamping device. Also eliminated are the additional bores in the body of the cleaning implement, which were previously necessary for holding the spring members. As contrasted with the other known constructions referred to all the conceivable forces, which could be exerted on the two branch arms to cause premature opening of the device, are absorbed because of the invention the clamping device is mounted, at least in the clamping position; upon both of the branch arms and these forces are transmitted into the support means.

According to the several embodiments of the present invention the clamping device may comprise a pivoting lever, which is either a two-armed lever arranged at one side of both of the branch arms, or else is mounted between said branch arms. In the first case the pivoting lever is movable in the plane defined by the branch arms, and in the other case normal thereto.

Preferably those ends of the branch arms which are to engage in the holes in the body of the cleaning implement are upset, and when in the assembled position these ends engage in undercuts in the holes. This provides a positive securing of the branch arms equally whether these are releasable by or in opposition to the spring force thereof.

These and other objects, features and advantages of the present invention will become appraent from the following description when taken in connection with the accompanying drawings, which show, for purposes of illustration only, several embodiments in accordance with the present invention.

DETAILED DESCRIPTION OF THE DRAWINGS

Figure 1:
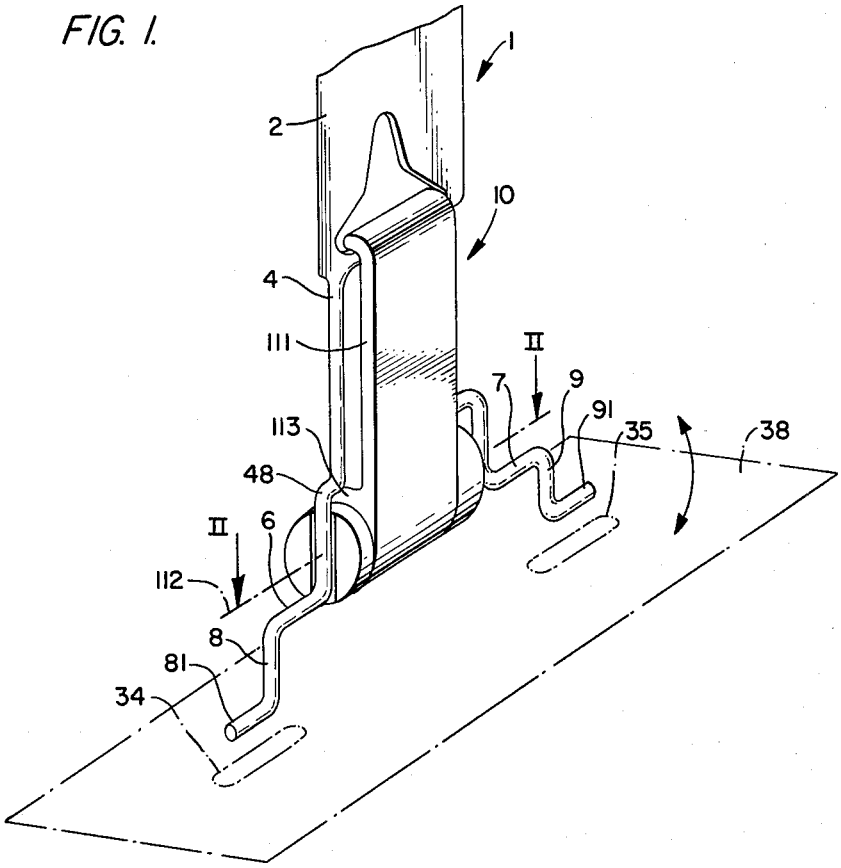
FIG. 1 is a perspective view of one embodiment of the present invention.
Figure 4:
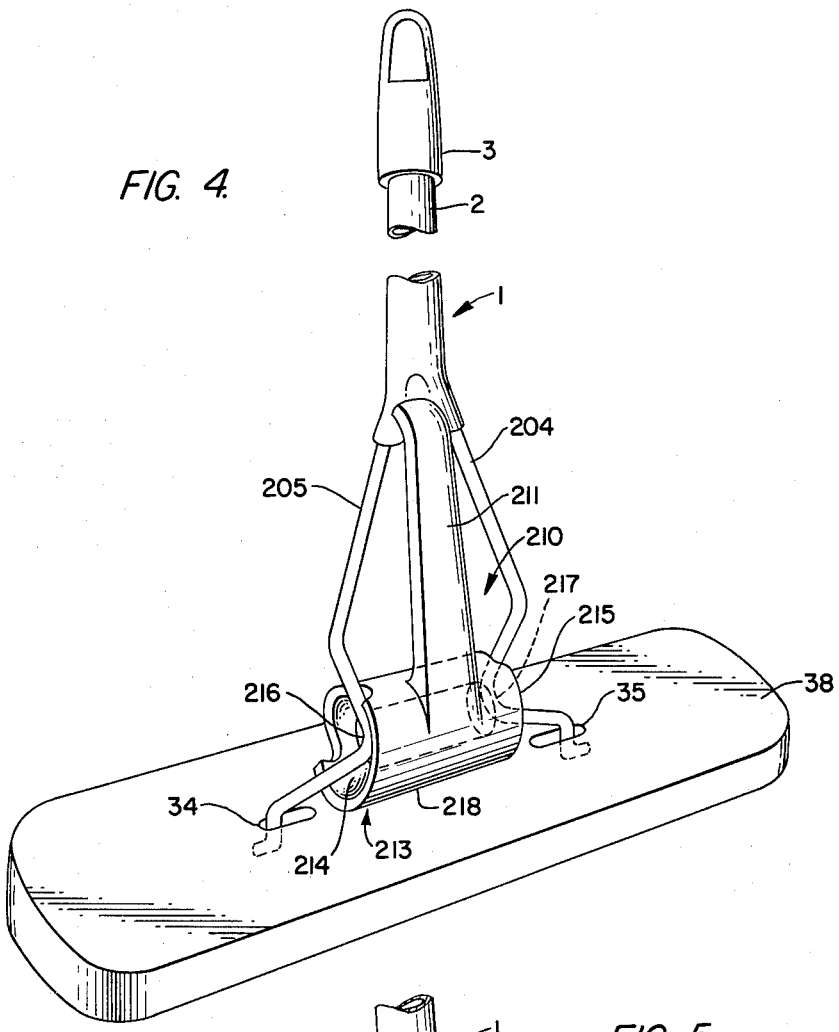
FIG. 4 is a perspective view of a second embodiment of the clamping device in the clamped or mounted position.

The handle 1 illustrated in FIG. 1 comprises a body 2 of tubular or rod cross section, at one end of which there may be attached, for example, a protective cap or suspension strap 3 as illustrated in FIG. 4, for example. At the other end the handle 2 is provided with two parallel branched arms 4, 5, forming a fork.

Figure 2:
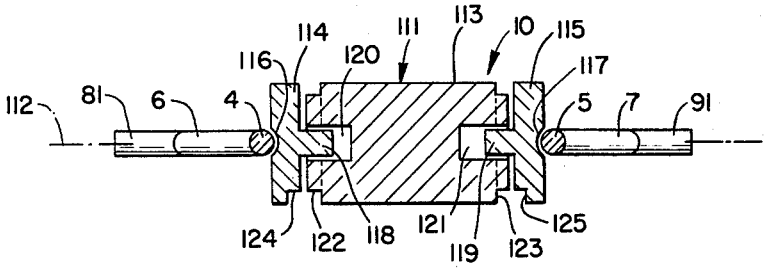
FIG. 2 is a section along the line II—II of FIG. 1 in the clamped or mounted position.
Figure 3:
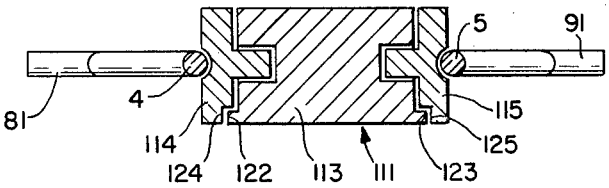
FIG. 3 is a section according to FIG. 2 in the open position.

In the embodiment of FIGS. 1 to 3, the clamping device 10 includes a pivoted lever 111, which is pivotable in a plane situated normal to the plane of the branch arms 4,5, and it is mounted in a pivot axis 112 extending between the branch arms 4,5. For this purpose the pivoted lever 111 has a cylindrical bearing member 113, which is arranged between the branch arms, 4,5. Between the end faces of the cylindrical bearing member 113 and the branch arms 4,5 there is arranged in each case a pressure disc 114, 115, each of which is provided at its outer end side with a diametrally directed slot 116,117, which engages a part of the respective branch arm 4,5. The pressure discs 114, 115 are provided with studs 118,119, which engage in bores 120, 121 of the cylindrical bearing member 113. In combination with the bores 120,121 these studs 118,119 constitute the pivoting axis of the pivoted lever 111. The pressure discs 114,115 and the cylindrical bearing member 113 of the pivoted lever 111 are held together by the spring force exerted by branch arms 4,5.

In order to avoid any upward sliding displacement of the cylindrical bearing member 113, the branch arms, 4,5 are provided with bent portions 48. (FIG. 1) positioned immediately above the cylindrical bearing member. Any downward slipping of the bearing member is prevented by the fact that the bent out portions 6,7 of the branch arms 4,5 are so arranged that the cylindrical bearing member 113 is situated in a position only slightly above the back surface of the implement body 38. In place of this arrangement it is also possible to provide the branch arms with an inwardly directed bent portion below the bearing member so that the clamping device is fixed between the branch arms when the device is in the non-assembled condition.

In this embodiment, the cylindrical bearing member 113 is provided at its end faces with projections 122, 123, for example of arcuate shape, whilst the pressure discs 114, 115 are provided with corresponding incisions 124, 125 at their end faces facing the cylindrical bearing member 113.

In the opened position of the clamping device, the projections 122, 123 engage the incisions 124,125 under the spring force exerted by the branch arms 4,5, so that the pressure discs 114, 115 have the minimum spacing-(FIG. 3). Whilst in this position the upset ends 81, 91(FIG. 1) of the branch arms 4,5 are introduced into the holes 34,35 of the body 38 of the implement. At this time the pivoting lever 111 has been swung out forwardly as compared with FIG. 1. By swinging up the pivoted lever 111 into the position shown in FIG. 1, the pressure discs 114,115 are forced outwardly, whereby the projections 122,123 upon the cylindrical bearing member 113 disengage from the incisions 124,125 and support themselves against the end faces of the pressure discs 114, 115 facing the bearing member. At the same time the studs 118,119 of the pressure discs are displaced to some extent outwardly from the bores 120,121. At the same time the branch arms 4,5 are forced outwardly so that the upset ends 81,91 again engage behind suitably shaped undercuts in the body of the implement, whilst the downwardly directed bent portions 8,9 of the branch arms are resiliently clamped against the interior wall at the outer end of the holes 34,35. In order to facilitate the swinging of the pivoted lever 111, it is possible to arrange inclined surfaces, not shown in the drawing, between the incisions 124,125 and the end surfaces of the pressure discs 114,115, as well as between the projections 122,123 and the end faces of the bearing member 113.

Similarly a further locking action can be arranged to be effective, if desired, when the parts are in the clamping position shown in FIG. 2. Moreover, it is possible to provide further projections and incisions arranged diametrally opposite those already described. The practical form according to FIG. 1 can obviously also be modified in such a manner that the pressure discs lie at the outer side of the branch arms, and the pivoting lever engages these at their outer side so that the branch arms are not forced outwardly but are drawn inwardly to effect the clamping. The upset ends 81,91 are then correspondingly directed inwardly. Also, a single pressure disc could be employed at one end of cylindrical bearing member with the other end thereof merely acting as a support-pivot for the adjacent branch arm.

The spacing between the free upset ends of the branch arms can be so selected in dependence upon the spacing between the inner(see FIG. 9)and the outer wall(FIG. 1)of the holes 34,35 that firstly one of these ends is introduced into a hole, whereafter the other end is inserted, so that even when the device is in the unclamped position there is an anchorage of the ends of the branch arms in the holes and the assembly of the device is simplified. Moreover the stability of the connection in the assembled position is improved.

In FIGS. 4 to 8, handle 1 again consists of a tube 2, with a protective cap or suspension strap 3 on one end. At the other end of the handle, fork-shaped ends engage holes 34,35 in body 38. A clamping device 210 is used to lock them in place, said device being disposed between fork arms 204 and 205.

The clamping device consists of a tensioning lever 211 and a cylindrical bearing member 213, integral with said lever. The entire clamping device 210 can be made for example, by injection molding from plastic. In the embodiment shown, bearing part 213 is designed as a segment of a tube, into whose ends 214,215 parts 216,217 of fork arms 204 and 205 can engage, said parts being bent inward in a V-shape. These bent parts 216,217 in conjunction with tube 218, constitute a rotational axis about which lever 211 can be moved from the tensioned position shown in FIG. 4 to the open position shown in FIG. 5. In this position, handle 1 together with clamping device 210 can be removed from body 38 of the cleaning implement.

Figure 6:
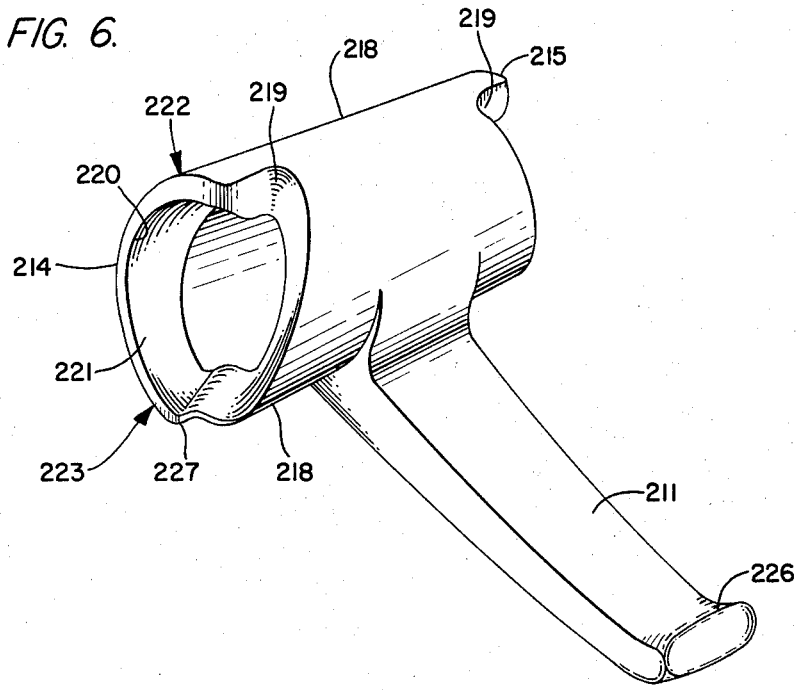
FIG. 6 is an enlarged perspective view of the clamping device according to FIG. 4, in the position according to FIG. 5.

In order to accomplish these functions, the clamping device is designed as follows (FIG. 6). Initially, an essentially radial notch 219 is provided at the ends 214,215 of the tubular bearing part 218, in such manner that the tube has the desired axial width at this point. These notches 219 permit the tube 218 and/or the entire clamping device 210 to be pushed in from the open side between fork arms 204 and 205 and/or the V-shaped bent parts 216,217, whereby the fork arms are spread apart slightly, so that after the wall thickness of the tube has passed into the interior of the tube, they can snap together and the clamping device 210 is suspended on bent parts 216,217, and cannot be forced out without exerting pressure. Tube 218 is provided with a curve 220 at its ends, said curve being maintained in the embodiment shown by virtue of the fact that the end has a recess which is conical and extends over a portion of the circumference of the tube, whereby the axis of cone 221 is displaced slightly eccentrically relative to the axis of tube 218. This displacement is evident from FIG. 7 by virtue of the fact that the portion of the wall which remains outside is larger in area 222 than in area 223.

Figure 5:
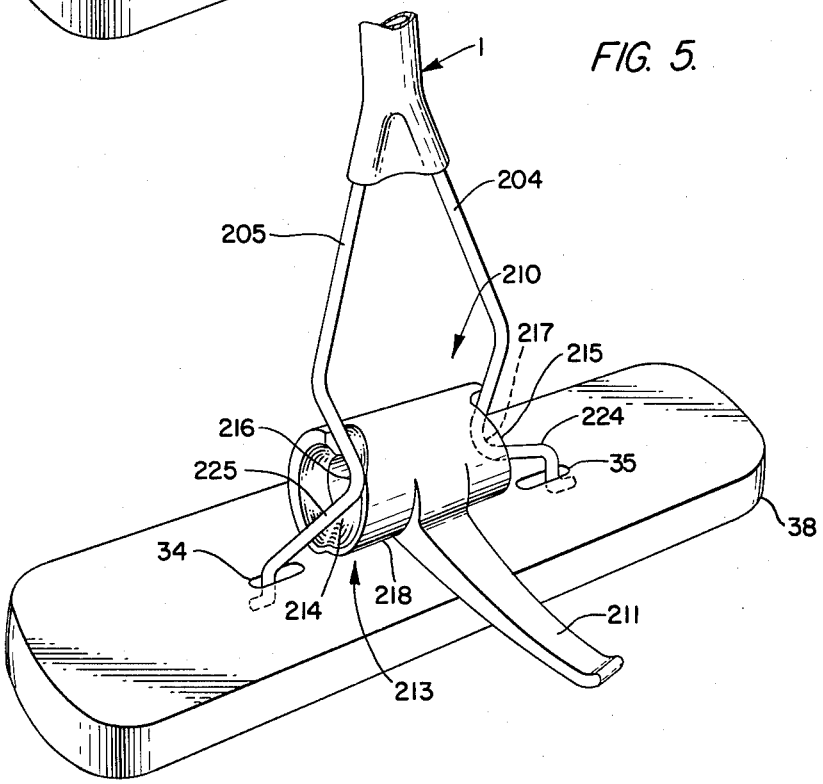
FIG. 5 is a view corresponding to FIG. 4, in the open position.

The V-shaped bent parts 216,217 on fork arms 204 and 205 are designed so that the shoulders 224,225 in the open position shown in FIG. 5 abut area 223 of conical recess 221. When lever 211 is swung up into the position shown in FIG. 4, shoulders 224,255 slide into the area 222 of the conical recess. Since the free cross-section in which the bent parts 216,217 engage is narrowed in the course of this motion, the bent parts are forced outward and hence the free bent ends of fork arms 204 and 205 are forced out as well, into the recesses 34,35 of body 38. The end position of lever 211 is defined by the fact that its slightly bent end 226 comes to rest aginst handle 1. In addition, a stop in the from of an axially extended step 227 can be provided on the end of the tubular bearing part 218.

Figure 7:
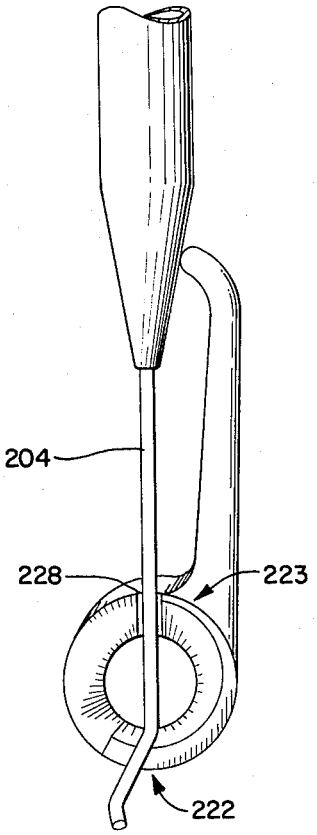
FIG. 7 is a side view of the clamping device in the clamped position.
Figure 8:
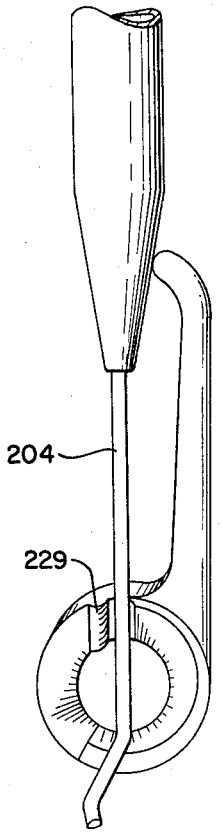
FIG. 8 is a view similar to FIG. 7, showing a modified embodiment.

In order to keep the clamping device in the clamping position even when considerable impacts are applied, as groove 228 can be provided at the ends of the tube, into which groove fork arms 204 and 205 engage (FIG. 7). Alternatively, a rib 229 can be disposed on the ends of tubular bearing part 218, behind which rib fork arms 204 and 205 can lock into the clamping position.

While in the embodiment of FIGS 4–8 a conical recess 221 is provided on each end of tube 218, it is understood that a conical recess could be provided on only one end of the tube forcing out the free bent ends of the fork arms, the other end of the tube merely having for example, a simple hollow for retaining the V-shaped end of the associated branch arm.

Figure 9:
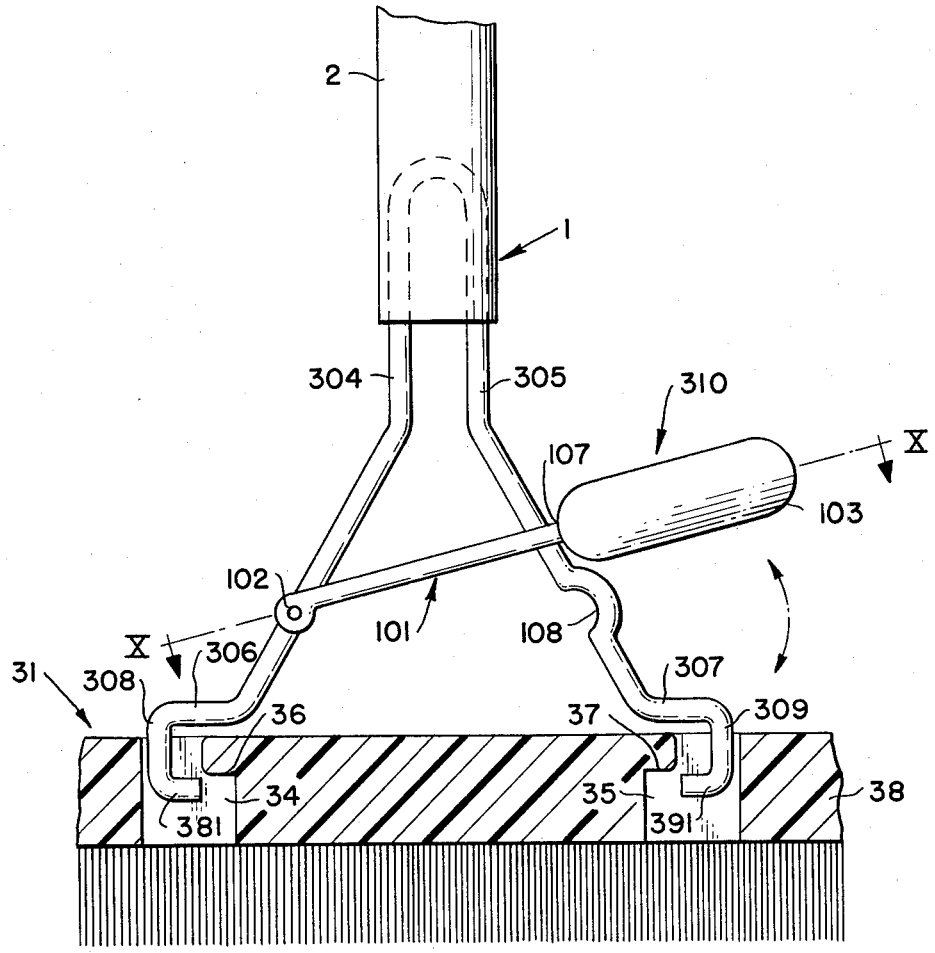
FIG. 9 is a partial elevation of another embodiment of a pivoted clamping device according to the present invention during the mounting thereof.

In the embodiment of FIG. 9 the branch arms 204, 205, 304,305 include substantially horizontally extending bent portions 306,307, continuing into right-angle bends 308,309 and inwardly directed upset portions 381,391. The implement body 38 possesses holes 34,35 which are provided with undercuts 36,37, the edges thereof being rounded. Between the branch arms 304,305, there is fitted the clamping device 310, which in this practical form includes a pivoted level 101, which is hinged at one end at the point 102 and possesses a manual operating member 103 at the other end. The manual operating member 103 serves at the same time as a clamping member.

Figure 10:
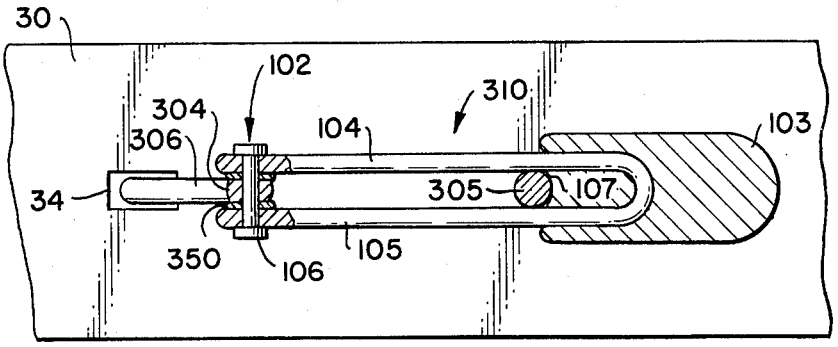
FIG. 10 is a section along the LINE X—X of FIG. 9.

As may be seen more clearly in FIG. 10, the pivoted lever 101 comprises two parallel limbs 104, 105 of a U-shaped wire loop, which in the region of its bridge piece is provided wih the operating member 103 formed by injection molded synthetic plastics material. The limbs 104, 105 are pivoted to the branch arm 304 by means of a transverse pin 106 penetrating said arm. The branch arm 304 may for this purpose be flattened at the required point 350.

In FIG. 9, one position of the branch arms 304, 305 is shown immediately before the assembly. The upset ends 381, 391 of the bent portions 308, 309 of the branch arms 304, 305 have been introduced into the holes 34, 35 of the implement body 38. Subsequently, the pivoted lever 101 is swung downwardly by means of the manual operating member 103. Thereby the inner edge 107 of the manual operating member 103 slides over the outer surface of the branch arm 305 until it snaps over a projecting nose piece 108 of the branch arm 305. (see FIG. 9). At this poine the pivoted lever 103 is in the locked position. In this clamped position the inwardly upset ends 81, 91 of the branch arms 304, 305 have engaged behind the undercuts 36, 37 in the holes 34, 35 of the implement body 38. At the same time the downwardly directed bent portions 308, 309 of the branch arms 304, 305 are resiliently forced against the upper inner side of the holes 34, 35. The handle 1 is thus securely assembled to the implement body 38.

Figure 11:
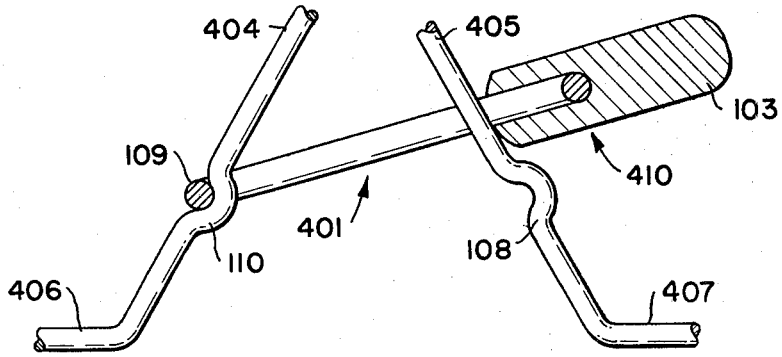
FIG. 11 is a partially sectioned front elevation of an embodiment which is modified as compared with FIGS. 9 and 10.

In the modified embodiment of FIG. 11, the pivoted lever may again consist of two limbs as may be seen in FIG. 10. However these limbs are connected together to form a U-loop at the point of pivoting, the bridge piece 109 forming the pivoting axis. This bridge piece 109 engages in a substantially semicircular bent portion 110 of the branch arm 404. In other respects the clamping device 410 possesses the same components as in the practical form shown in FIGS. 9 and 10. Moreover its function is the same.

Figure 12:
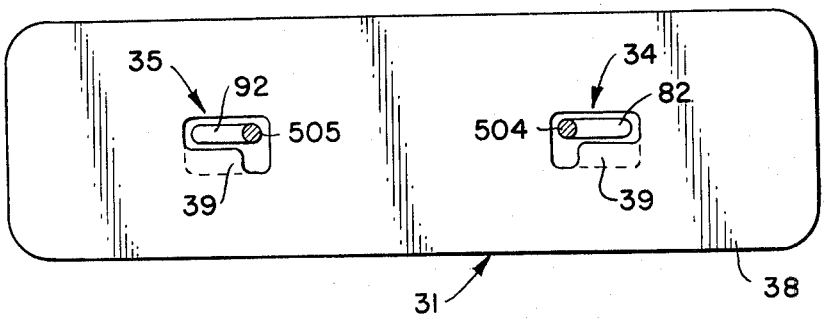
FIG. 12 is a plan view of one form of the body of a cleaning implement.

In FIG. 12 there is shown a practical example of the formation of the holes in the body of the cleaning implement. These holes have a rectangular cross section, the longitudinal dimension of which extends in the direction of the long axis of the body, and the length of which corresponds approximately to the length of the upset end, for example 82 or 92 of the branch arms 504, 505. Near to the surface of the body these holes are narrowed to an angular cross section by a corner projection 39. The branch arms 504, 505 are inserted in the position shown in FIG. 12 and following this are so displaced that the upset ends 82, 92 engage behind the projections 39. Then the clamping device is operated so that the branch arms spread outwardly and frictionally engage against the outer wall of the shorter transverse slot.

While we have shown and described only several embodiments in accordance with the present invention, it is understood that the same is not limited thereto but is susceptible of numberous changes and modifications as would be known to those skilled in the art, given the present disclosure, we therefore do not wish to be limited to the details shown and described herein but intend to cover all such changes and modifications as are encompassed by the scope of the appended claims.

We claim:

1. A clamping device for releasably securing a cleaning implement body to a handle having an end portion comprising two sprung branch arms in the form of a fork, the arms having bent end portions and being securable in apertures of said body by means of the clamping device which is adapted to be movable between said branch arms for releasably securing the end portions thereof in the apertures of said body, said clamping device including a pivoting lever for pivotable movement between the branch arms in a plane substantially perpendicular to the plane including the branch arms, said pivoting lever having a bearing member for extending between the two branch arms and forming an axis, said bearing member being adapted to act upon the branch arms to move the end portions thereof for releasably securing said cleaning implement body to said handle when the bearing member is turned about its axis by pivoting the lever.

2. A device according to claim 1, wherein said bearing member is cylindrical and is provided with a pressure disc for arrangement between an end face of the bearing member and the inner side of a branch arm, the bearing member and the pressure disc being connected by a trunnion in the pivoting axis with at least one projection being formed on one of the opposing faces of said bearing member and said pressure disc fcr forcing the same apart when the bearing member is turned about its axis by pivoting the lever.

3. A device according to claim 2, wherein said bearing member is provided with such a pressure disc at each of opposed end faces of the bearing member for arrangement between the end faces o the bearing member and each branch arm.

4. A device according to claim 3, wherein each pressure disc is provided at its outer end face with a diametrally directed slot for engaging a portion of the adjacent branch arm.

5. A device according to claim 1, wherein said bearing member is cylindrical and is provided with end faces each having a hollow for engagement by projecting parts at the branch arms to form the pivoting axis of the pivoting lever, at least one of said end faces forming a cam for spreading the branch arms when the lever is pivoted about said axis.

6. A device according to claim 5, wherein the projecting parts of the branch arms are V-shaped inwardly bent portions thereof.

7. A device according to claim 6, wherein the bearing member is a section of a tube the end faces of which each comprise a hollow having its wall at least partly cone-shaped and constituting said cam, the axis of said cone being arranged slightly eccentrically with regard to the axis of the tube, said cone-shaped wall being for engagement by the legs of the V-shaped bent portions of the branch arms.

8. A device according to claim 7, wherein means are provided on at least one of said end faces for holding the pivoting lever in a clamping position.

9. A device according to claim 8, wherein said means for holding the pivoting lever in a clamping position comprises a groove extending along the cone-shaped wall of an end face.

10. A device according to claim 8, wherein said means for holding the pivoting lever in a clamping position comprises a projecting rib extending along the cone-shaped wall of an end face.

11. A device according to claim 6, wherein each of said end faces of said cylindrical bearing member are provided with a notch extending substantially radially and permitting the V-shaped bent portions of said branch arms to be placed in said hollows of the bearing member.

12. A device according to claim 5, wherein means are provided on at least one of said end faces for holding the pivoting lever in a clamping position 13. A device according to claim 12, wherein said means for holding the pivoting lever in a clamping position comprises an axially projecting rib provided on one of said end faces.

14. A device according to claim 12, wherein said means for holding the pivoting lever in a clamping position comprises a groove provided in one of said end faces.

15. A device according to claim 5, wherein said bearing member and said pivoting lever are formed as one piece of a plastic material.

16. A device according to claim 1, in combination with said handle and said cleaning implement body wherein the apertures in said body include undercuts, the vent end portions of the branch arms when in the assembled position, engaging behind the undercuts in said apertures.

17. A device according to clim 16, wherein said apertures have a generally rectangular cross section but near the upper side of said body are narrowed to an angular cross section by rectangular corner projections defining said undercuts.

* * * * *